US009212439B2

(12) United States Patent
Suzuki

(10) Patent No.: US 9,212,439 B2
(45) Date of Patent: Dec. 15, 2015

(54) THREADER FOR OVERLOCK MACHINE

(71) Applicant: Jaguar International Corporation, Osaka (JP)

(72) Inventor: Yoshikazu Suzuki, Osaka (JP)

(73) Assignee: Jaguar International Corporation, Osaka (JP)

( * ) Notice: Subject to any disclaimer, the term of this patent is extended or adjusted under 35 U.S.C. 154(b) by 0 days.

(21) Appl. No.: 13/979,989

(22) PCT Filed: Nov. 30, 2012

(86) PCT No.: PCT/JP2012/081025
§ 371 (c)(1),
(2) Date: Jul. 16, 2013

(87) PCT Pub. No.: WO2013/125120
PCT Pub. Date: Aug. 29, 2013

(65) Prior Publication Data

US 2015/0330006 A1 Nov. 19, 2015

(30) Foreign Application Priority Data

Feb. 22, 2012 (JP) ..... 2012-036042

(51) Int. Cl.
*D05B 87/02* (2006.01)
*B65H 57/00* (2006.01)

(52) U.S. Cl.
CPC ..... *D05B 87/02* (2013.01); *B65H 57/00* (2013.01)

(58) Field of Classification Search
CPC .... D05B 87/02; D05D 2207/00; B65H 57/00; B65H 57/06
USPC ..... 112/225, 302
See application file for complete search history.

(56) References Cited

U.S. PATENT DOCUMENTS 4,651,660 A * 3/1987 Oshima ..... D05B 87/02 112/225

(Continued)

FOREIGN PATENT DOCUMENTS

JP 03133483 A * 6/1991
JP 10099582 A * 4/1998

(Continued)

OTHER PUBLICATIONS

Written Opinion of International Searching Authority for related patent No. PCT/JP2012/081025, Aug. 2014.

*Primary Examiner* — Ismael Izaguirre
(74) *Attorney, Agent, or Firm* — Husch Blackwell, LLP

(57) ABSTRACT

Provided is a threader for an overlock machine that allows the whole machine to be made compact and allows an operator to carry out threading reliably with one hand. The threader comprises: a threading shaft that moves vertically and is supported rotatably, with a shaft core being taken as a central axis; a threading hook that is fixed to the lower end of the threading shaft and that includes a hook part that can be inserted into the needle eye of a sewing needle and a first guide part that guides the hook part to the needle eye; and a thread guide member that guides a needle thread to the hook part in the vicinity of the descent limit point of the threading shaft. The threading hook is rotated by a predetermined angle so that the hook part is inserted into the needle eye of the sewing needle in the vicinity of the descent limit point of the threading shaft. The threading hook and the thread guide member are rotated in opposite directions to each other and thereby the thread guide member is rotated by the predetermined angle so that the thread hooking part intersects the sewing needle beyond the position of the sewing needle in the vicinity of the descent limit point of the threading shaft. The threading shaft moves according to the relative positional relationship between the needle eyes of a plurality of sewing needles.

5 Claims, 11 Drawing Sheets

(56) References Cited

U.S. PATENT DOCUMENTS

| | | | | | |
|---|---|---|---|---|---|
| 5,072,678 | A * | 12/1991 | Satoma | D05B 87/02 | 112/163 |
| 5,195,452 | A * | 3/1993 | Kamiya | D05B 87/02 | 112/225 |
| 5,615,629 | A * | 4/1997 | Yamada | D05B 87/02 | 112/225 |
| 8,028,634 | B2 * | 10/2011 | Miyoshi | D05B 87/02 | 112/225 |
| 2010/0043686 | A1 * | 2/2010 | Suzuki | D05B 87/02 | 112/225 |

FOREIGN PATENT DOCUMENTS

| | | |
|---|---|---|
| JP | 10-137482 | 5/1998 |
| JP | 2008-012053 | 1/2008 |
| JP | 2009-219699 | 10/2009 |
| JP | 2009-226142 | 10/2009 |
| JP | 2010-017320 | 1/2010 |

* cited by examiner 5
51
52
62
6
61
142a
142b
4
12
20
41
101
111
63
17

5
51
52
62
6
142b
61

4
12
20
101
41
63
111
17

5
51
52
142b
142a
62
6
61
20
12
4
101
41
63
111
17

THREADER FOR OVERLOCK MACHINE

TECHNICAL FIELD

The present invention relates to a threader for an overlock machine that can respectively thread needle eyes of a plurality of sewing needles attached to a needle bar by vertically moving and rotating one threading shaft located near the needle bar.

BACKGROUND ART

Conventionally, an overlock machine has been developed that is provided with a plurality of sewing needles for sewing processed fabric and is equipped with a threader that can easily carry out a troublesome operation of threading the needle eyes of a plurality of sewing needles. For example, Patent Document 1 discloses a threader that has a needle bar supported in an oblique direction with respect to the cloth feeding direction in such a manner as to be capable of moving vertically and that carries out threading by catching a thread stretched near the needle eye of a sewing needle attached to the needle bar by a threading hook and allowing the threading hook, which has caught the thread, to move so as to be drawn into the needle eye of the sewing needle.

In overlock machines provided with a plurality of sewing needles, the heights of the needle eyes of the respective sewing needles are different from each other. In the threader disclosed in Patent Document 1, the threading shaft is attached in such a manner as to incline with respect to the direction of vertical motion of the needle bar with the sewing needles attached thereto, the threading shaft is rotated to move the threading hook so that the threading hook approaches or separates from the needle eyes of the sewing needles, and the threading hook, which has caught the thread, can pass through the needle eye of each sewing needle.

PRIOR ART DOCUMENTS

Patent Documents

[Patent Document 1] JP 3737584 B

SUMMARY OF THE INVENTION

Problem to be Solved by the Invention

In Patent Document 1, however, it is necessary to finely control the timing to move the threading hook so that the threading hook approaches or separates from the needle eyes of the sewing needles and the timing to vertically move the threading shaft, with the threading shaft itself being rotated while being attached in such a manner as to incline with respect to the direction of vertical motion of the needle bar, with the sewing needles attached thereto. Consequently, the number of parts increases and thereby it is difficult to reduce the size of the whole machine as well as the cost thereof, which have been problems.

The present invention was made with such situations in mind and is intended to provide a threader for an overlock machine that allows the whole machine to be made compact and allows an operator to carry out threading reliably with one hand.

Means for Solving Problem

In order to achieve the above-mentioned object, a threader for an overlock machine according to a first invention comprises: a threading shaft that is located near a needle bar, which collectively and vertically moves a plurality of sewing needles attached thereto, that can move in substantially parallel with a direction of vertical motion of the needle bar, and that is supported rotatably, with the direction of vertical motion of the needle bar being taken as a rotation axis; a threading hook that is fixed to a lower end of the threading shaft and that includes a hook part, which can be inserted into a needle eye of a sewing needle and a first guide part for guiding the hook part to the needle eye; a first rotary mechanism that rotates the threading hook by a predetermined angle so that the hook part is inserted into the needle eye of the sewing needle in a vicinity of a descent limit point of the threading shaft; a thread guide member that has a thread hooking part for hooking a needle thread and a second guide part for guiding the needle thread hooked on the thread hooking part towards the needle eye of the sewing needle and that guides the needle thread to the hook part in the vicinity of the descent limit point of the threading shaft; and a second rotary mechanism that rotates the thread guide member by the predetermined angle so that the thread hooking part intersects the sewing needle beyond the position of the sewing needle in the vicinity of the descent limit point of the threading shaft, wherein the first rotary mechanism and the second rotary mechanism rotate the threading hook and the thread guide member in opposite directions to each other, and the threading shaft moves according to a relative positional relationship between the needle eyes of the plurality of sewing needles.

In the first invention, one threading shaft is provided that is located near the needle bar, which collectively and vertically moves the plurality of sewing needles attached thereto, that can move in substantially parallel with the direction of vertical motion of the needle bar, and that is supported rotatably, with the direction of vertical motion being taken as a rotation axis. The threading hook including the hook part that can be inserted into the needle eye of the sewing needle and the first guide part for guiding the hook part to the needle eye is fixed to the lower end of the threading shaft. The first rotary mechanism rotates the threading hook by the predetermined angle so that the hook part is inserted into the needle eye of the sewing needle in the vicinity of the descent limit point of the threading shaft. The thread guide member is provided that has the thread hooking part for hooking the needle thread and the second guide part for guiding the needle thread hooked on the thread hooking part towards the needle eye of the sewing needle and that guides the needle thread to the hook part in the vicinity of the descent limit point of the threading shaft. The second rotary mechanism rotates the thread guide member by the predetermined angle so that the thread hooking part intersects the sewing needle beyond the position of the sewing needle in the vicinity of the descent limit point of the threading shaft. The first rotary mechanism and the second rotary mechanism rotate the threading hook and the thread guide member in opposite directions to each other and the threading shaft moves according to the relative positional relationship between the needle eyes of the plurality of sewing needles. Accordingly, with the needle thread being hooked on the thread hooking part of the thread guide member, after the hook part of the threading hook is inserted into any one of the needle eyes, the needle thread guided by the thread guide member is hooked onto the hook part. With the hook part coming out of any one of the needle eyes, the needle thread passes through the needle eye and thereby threading is carried out. Thus, threading can be carried out reliably according to the vertical motion of one threading shaft and therefore the whole machine can be made compact and the cost thereof can be reduced. Furthermore, the threading shaft moves according to the relative positional relationship between the needle eyes of a plurality of sewing needles. Therefore, even when the heights of the needle eyes are different from each other according to the sewing needles, threading can be carried out reliably.

Furthermore, the threader for an overlock machine according to a second invention is characterized in that in the first invention, a support member that supports the threading shaft and that is fixed to an overlock machine body has a hole cam mechanism configured with a first cam hole, in which a first cam shaft provided in an upper part of the threading shaft fits, and a second cam hole, in which a second cam shaft provided in a lower part of the threading shaft fits, and the threading shaft is moved according to an operation of an operating member that moves a fitting position of the first cam shaft and a fitting position of the second cam shaft.

In the second invention, the support member that supports the threading shaft and that is fixed to the overlock machine body has the hole cam mechanism configured with the first cam hole, in which the first cam shaft provided in the upper part of the threading shaft fits, and the second cam hole, in which the second cam shaft provided in the lower part of the threading shaft fits. According to the operation of the operating member that moves the fitting position of the first cam shaft and the fitting position of the second cam shaft, the fitting position of the first cam shaft and the fitting position of the second cam shaft are moved and therefore threading can be carried out reliably, with the hook part of the threading hook being aligned with the position of the needle eye of the sewing needle without the threading shaft itself to be inclined with respect to the direction of vertical motion of the needle bar to be moved.

Furthermore, a threader for an overlock machine according to a third invention is characterized in that in the first or second invention, a threading guide member is comprised that is fitted onto or into the threading shaft to be fixed to the support member and that has a third cam hole and a fourth cam hole, the first rotary mechanism is configured with the third cam hole and a third cam shaft that is provided for the threading shaft and that fits in the third cam hole, the second rotary mechanism is configured with the fourth cam hole and a fourth cam shaft that is provided for the thread guide member and that fits in the fourth cam hole, an inclined direction of the third cam hole is opposite to an inclined direction of the fourth cam hole, and a first biasing member is provided between the threading hook and the thread guide member, that biases the thread guide member in such a manner that the thread guide member approaches the threading hook.

In the third invention, the threading guide member is comprised that is fitted onto or into the threading shaft to be fixed to the support member and that has the third cam hole and the fourth cam hole. The first rotary mechanism is configured with the third cam hole and the third cam shaft that is provided for the threading shaft and that fits in the third cam hole. The second rotary mechanism is configured with the fourth cam hole and the fourth cam shaft that is provided for the thread guide member and that fits in the fourth cam hole. The inclined direction of the third cam hole is opposite to the inclined direction of the fourth cam hole. When the first rotary mechanism rotates the threading hook clockwise (counterclockwise) about the threading shaft, the second rotary mechanism rotates the thread guide member counterclockwise (clockwise) about the threading shaft. Accordingly, the vertical motion of one threading shaft can control the relative positional relationship between the thread hooking part (the thread guide member) that guides the needle thread and the hook part (threading hook) that threads the needle eye and thereby threading can be carried out reliably. Thus, the whole machine can be made compact and the cost thereof can be reduced.

A threader for an overlock machine according to a fourth invention is characterized by, in any one of the first to third inventions, comprising an operating body that vertically moves the threading shaft.

In the fourth invention, the threader comprises the operating body that vertically moves the threading shaft. An operator can vertically move and rotate the threading shaft by vertically moving the operating body and thereby can carry out threading with one hand.

Furthermore, a threader for an overlock machine according to a fifth invention is characterized in that in the fourth invention, the operating body comprises: a base that is connected to the threading guide member and vertically moves the threading guide member; a needle thread holding part that holds the needle thread between the base and itself; and a second biasing member that biases the needle thread holding part upwards, and when the needle thread holding part is pushed down, a gap smaller than a diameter of the needle thread is generated between the base and the needle thread holding part.

In the fifth invention, when the needle thread holding part of the operating body is pushed down against the biasing force of the second biasing member, a gap smaller than the diameter of the needle thread is generated between the base and the needle thread holding part. Therefore, the needle thread can be held with a suitable tension and thereby the needle thread hooked on the thread guide member can be reliably hooked onto the hook part of the threading hook.

Effects of the Invention

According to the present invention, with the needle thread being hooked on the thread hooking part of the thread guide member, after the hook part of the threading hook is inserted into the needle eye, the needle thread guided by the thread guide member is hooked onto the hook part. With the hook part coming out of the needle eye, the needle thread passes through the needle eye and thereby threading is carried out. Thus, threading can be carried out reliably according to the vertical motion of one threading shaft and therefore the whole machine can be made compact and the cost thereof can be reduced. Furthermore, the threading shaft moves according to the relative positional relationship between the needle eyes of the plurality of sewing needles. Therefore, even when the heights of the needle eyes are different from each other according to the sewing needles, threading can be carried out reliably.

BEST MODE FOR CARRYING OUT THE INVENTION

Figure 1:
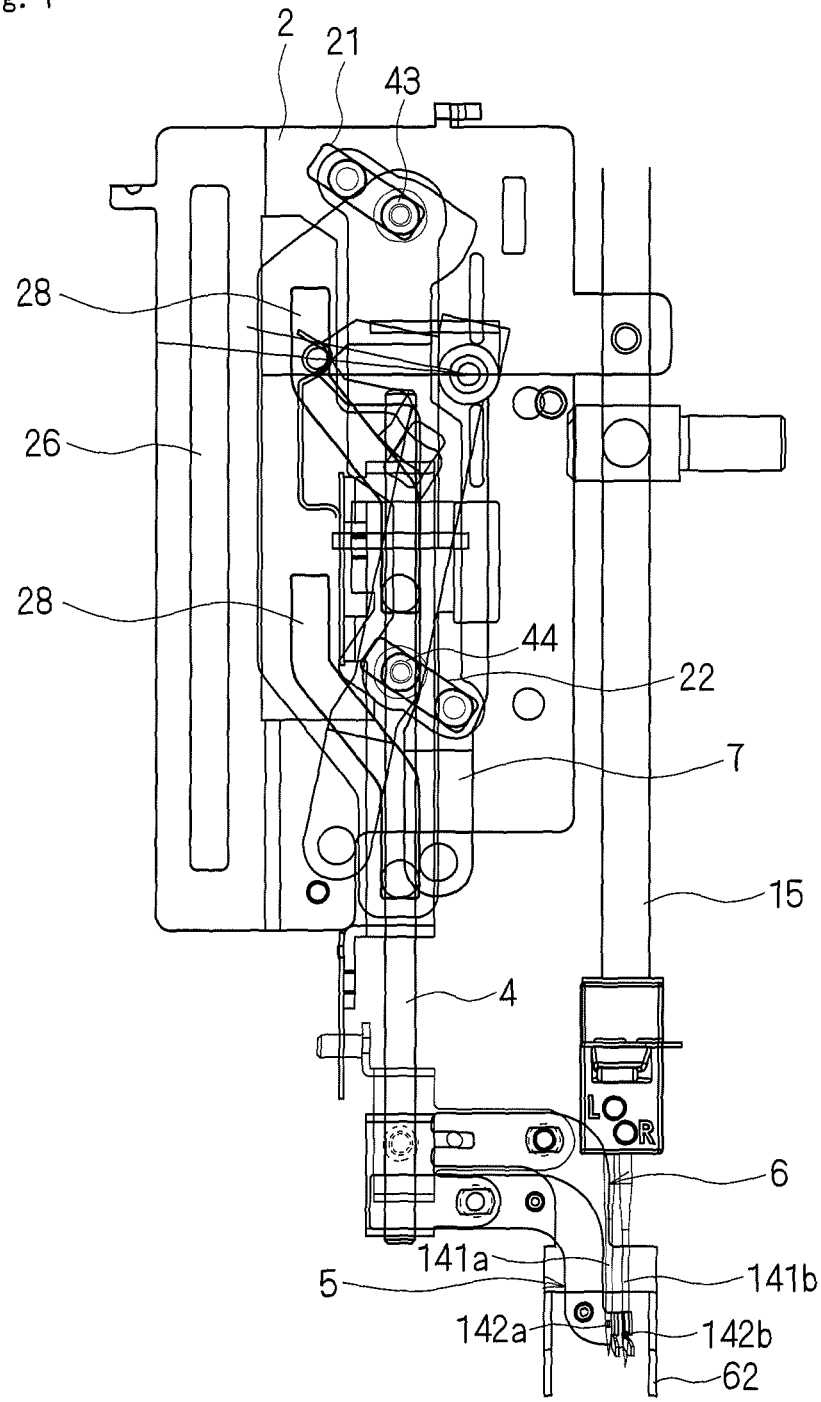
FIG. 1 is a front view showing the overall configuration of a threader for an overlock machine, viewed from the front, according to an embodiment of the present invention.

Hereinafter, the present invention is described with reference to the drawings that show an embodiment thereof. In the following descriptions, the front, back, right, and left described herein are directions as viewed by the operator of an overlock machine. FIG. 1 is a front view showing the overall configuration of a threader for an overlock machine, viewed from the front, according to the embodiment of the present invention.

As shown in FIG. 1, the threader according to the present embodiment is configured with: a threading shaft 4 disposed near a needle bar 15 to which two sewing needles 141*a*, 141*b* are attached; a threading hook 5 fixed to a lower end of the threading shaft 4; a first rotary mechanism (described later) that rotates the threading hook 5 by a predetermined angle in the vicinity of the descent limit point of the threading shaft 4; a thread guide member 6 that guides a needle thread to the threading hook 5 in the vicinity of the descent limit point of the threading shaft 4; a second rotary mechanism (described later) that rotates the thread guide member 6 by the predetermined angle in the vicinity of the descent limit point of the threading shaft 4; and a support member 2 that supports the threading shaft 4 movably in substantially parallel with the direction of vertical motion of the needle bar 15. In order to move the needle bar 15 vertically, a drive mechanism such as a stepping motor, which is not shown in the drawings, may be used and the drive mechanism is not particularly limited.

The threading hook 5 fixed to the lower end of the threading shaft 4 can rotate about the threading shaft 4 independently from the threading shaft 4. The thread guide member 6 that guides the needle thread to the threading hook 5 is attached to the upper part of the threading hook 5 in such a manner as to be capable of rotating about the threading shaft 4 independently from the threading shaft 4.

Figure 2A:
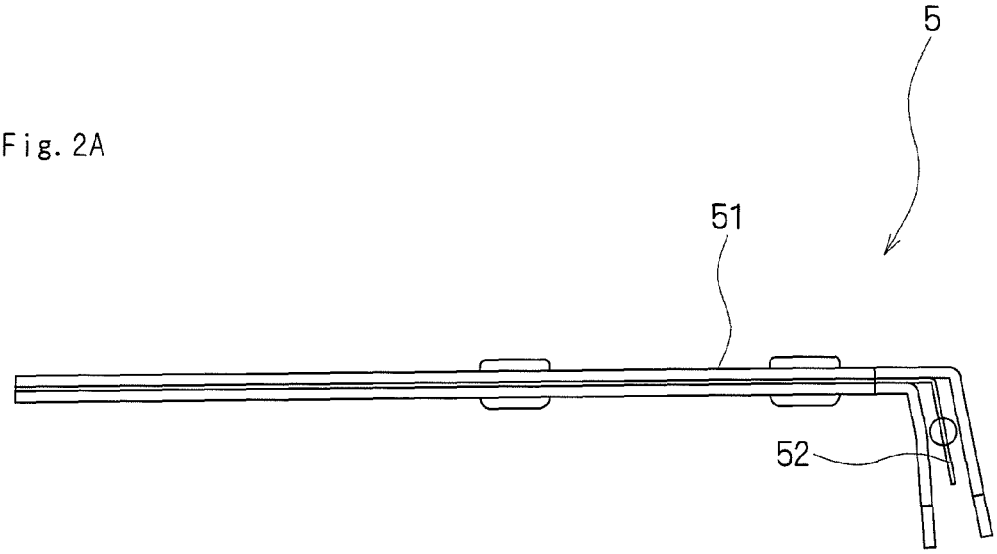
FIGS. 2A and 2B show a plan view and a front view respectively that illustrate the configuration of a threading hook of the threader for an overlock machine according to the embodiment of the present invention.
Figure 2B:
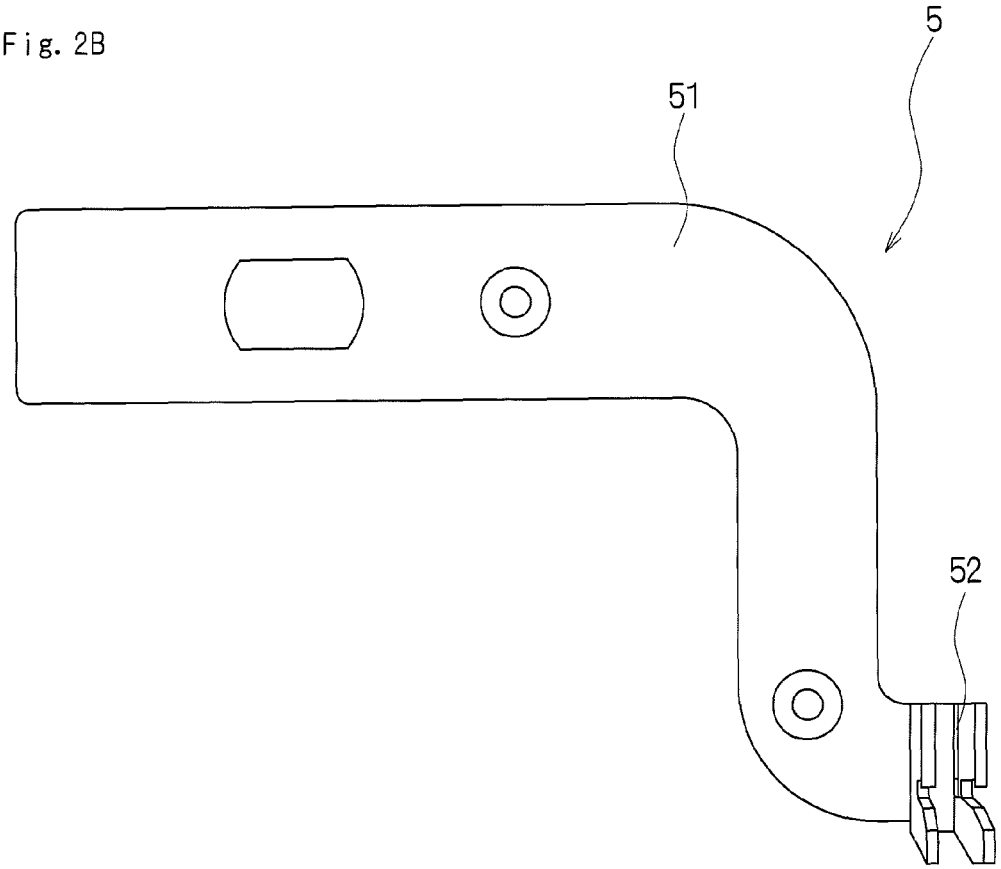

FIG. 2 shows a plan view and a front view that illustrate the configuration of the threading hook 5 of the threader for an overlock machine according to the embodiment of the present invention. FIGS. 2A and 2B show a plan view of the threading hook 5 of the threader for an overlock machine according to the embodiment of the present invention and a front view thereof, respectively. As shown in FIG. 2A, the threading hook 5 is configured with a two-pronged first guide part 51 and a hook part 52 provided in the center of the first guide part 51. The first guide part 51 guides the hook part 52 to a needle eye 142*a* or 142*b* of sewing needle 141*a* or 141*b* as the threading hook 5 rotates. The hook part 52 guided by the first guide part 51 is inserted into and drawn out from the needle eye 142*a* or 142*b* of the sewing needle 141*a* or 141*b*. Thus, the needle eye 142*a* or 142*b* is threaded with the hook part 52.

Figure 3B:
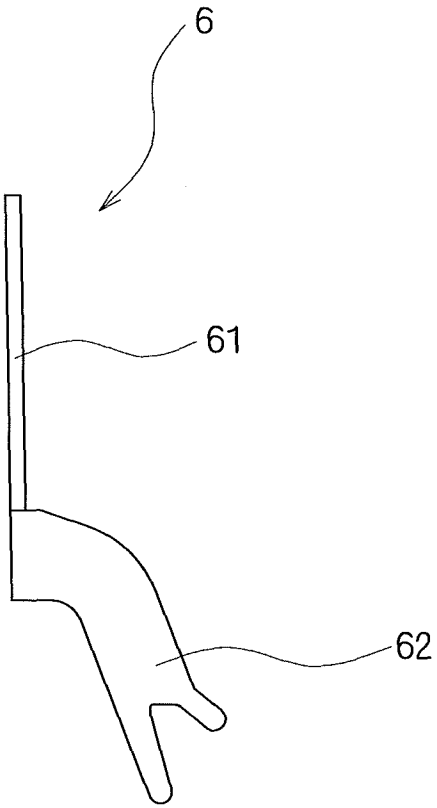
FIGS. 3A and 3B show a plan view and a front view respectively that illustrate the configuration of a thread guide member of the threader for an overlock machine according to the embodiment of the present invention.
Figure 3A:
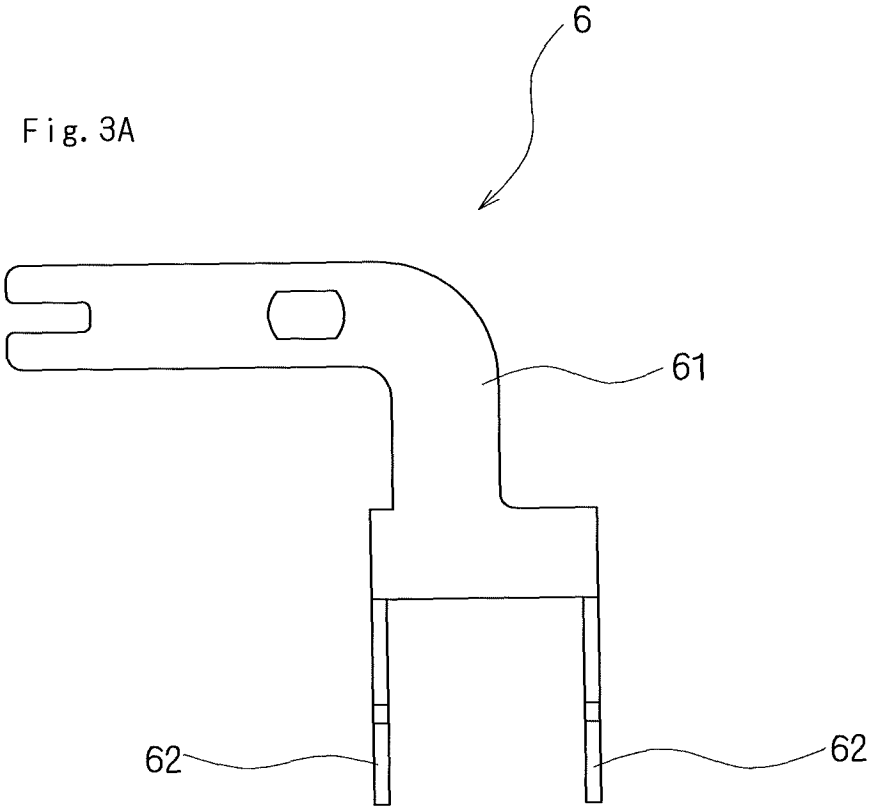

FIG. 3 shows a plan view and a front view that illustrate the configuration of the thread guide member 6 of the threader for an overlock machine according to the embodiment of the present invention. FIGS. 3A and 3B show a front view of the thread guide member 6 of the threader for an overlock machine according to the embodiment of the present invention and a plan view thereof, respectively. The thread guide member 6 guides the needle thread to the hook part 52 of the threading hook 5 in the vicinity of the descent limit point of the threading shaft 4. As shown in FIG. 3A, the thread guide member 6 is configured with a two-pronged thread hooking part 62 that hooks the needle thread and a second guide part 61 that guides the needle thread hooked on the thread hooking part 62 towards the needle eye 142*a* or 142*b* of the sewing needle 141*a* or 141*b*. As the thread guide member 6 rotates, the thread hooking part 62 approaches the needle eye 142*a* or 142*b* of the sewing needle 141*a* or 141*b* and guides the needle thread hooked on the thread hooking part 62 to the position where the hook part 52 of the threading hook 5 can hook the needle thread.

Furthermore, as shown in FIG. 1, a positioning lever (operating member) 7 is provided that adjusts the position of the threading shaft 4 according to the relative positional relationship between the needle eyes 142*a* and 142*b* of the two sewing needles 141*a* and 141*b*. The positioning lever 7 is swingably fixed to the support member 2 and adjusts the position of the threading shaft 4 according to the position of the needle eye 142*a* of the sewing needle 141*a* or the needle eye 142*b* of the sewing needle 141*b*, which is to be threaded, by the movement of a cam shaft support member that engages with an engaging part of the positioning lever 7.

Figure 4:
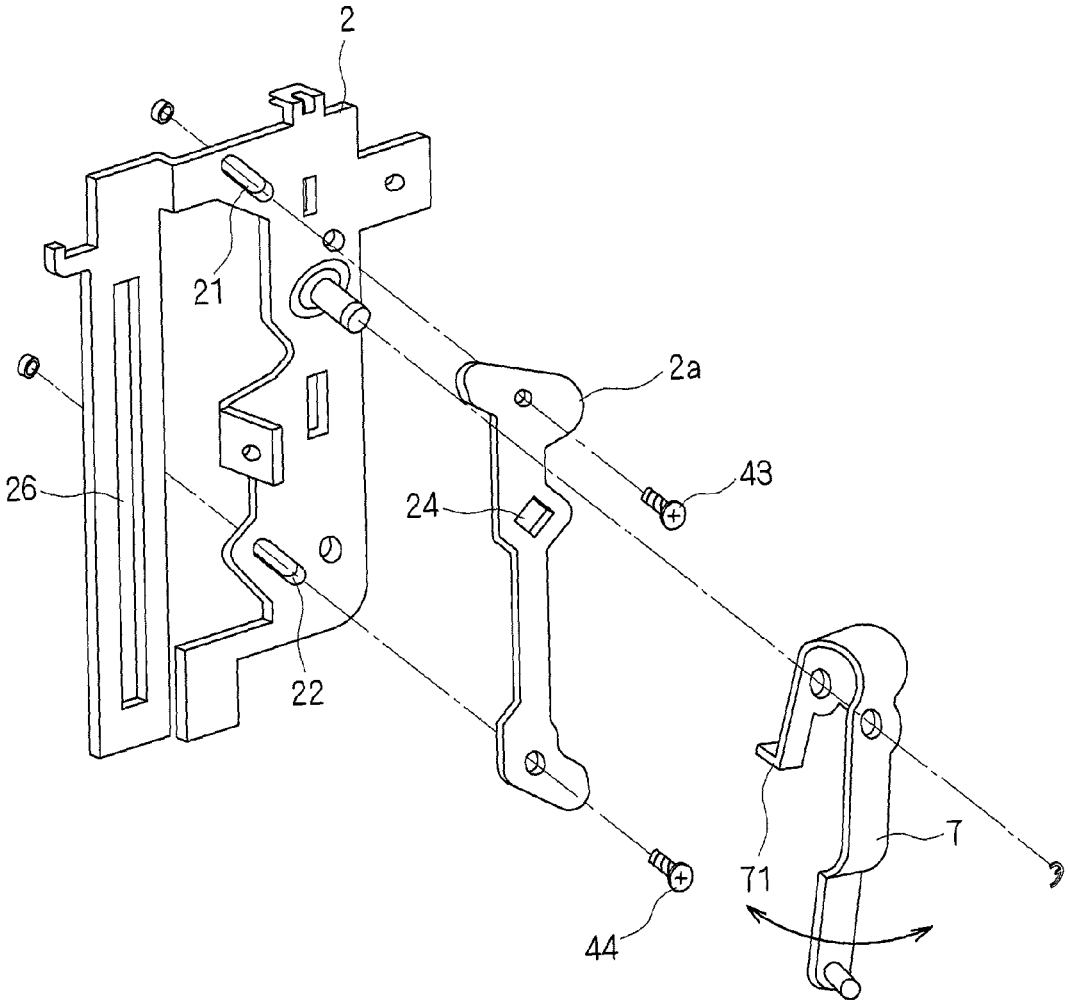
FIG. 4 is a perspective view for explaining the mechanism for adjusting the position of a threading shaft of the threader for an overlock machine according to the embodiment of the present invention.

FIG. 4 is a perspective view for explaining the mechanism for adjusting the position of the threading shaft 4 of the threader for an overlock machine according to the embodiment of the present invention. As shown in FIG. 4, the upper portion of the positioning lever 7 is curved and an engaging part 71 that engages with a cam shaft support member 2*a* is provided for the tip of the curved portion.

The engaging part 71 engages with an engaging hole 24 of the cam shaft support member 2*a* and the cam shaft support member 2*a* moves along a first cam hole 21 and a second cam hole 22 of the support member 2 according to the swing of the positioning lever 7. Specifically, the first cam hole 21 and the second cam hole 22 are provided in an upper part and a lower part of the support member 2, and the hole cam mechanism is configured with the first cam hole 21, in which a first cam shaft 43 provided in an upper part of the threading shaft 4 fits, and the second cam hole 22, in which a second cam shaft 44 provided in a lower part of the threading shaft 4 fits. The first cam shaft 43 and the second cam shaft 44 connect the cam shaft support member 2*a* and the support member 2 to each other. With the positioning lever 7 being swung, the cam shaft support member 2*a* moves and thereby the fitting positions of the first cam shaft 43 and the second cam shaft 44 that connect the cam shaft support member 2*a* are moved. With the fitting positions of the first cam shaft 43 and the second cam shaft 44 being moved, the threading shaft 4 can be moved to be aligned with the positions of the needle eyes 142*a* and 142*b* of the sewing needles 141*a* and 141*b* to be threaded.

For example, when the positioning lever 7 is swung to the right, the cam shaft support member 2*a* also moves to the right. Therefore, the first cam shaft 43 and the second cam shaft 44 move to the lower right along the first cam hole 21 and the second cam hole 22. With the moving distance and moving direction of the first cam shaft 43 and the second cam shaft 44, i.e., the length and inclined direction of the first cam hole 21 and the second cam hole 22, being allowed to coincide with the distance and direction between the needle eyes 142*a* and 142*b* of the sewing needles 141*a* and 141*b*, the threading shaft 4 can be moved according to the relative positional relationship between the needle eyes 142*a* and 142*b* of the sewing needles 141*a* and 141*b* to be threaded.

Figure 5B:
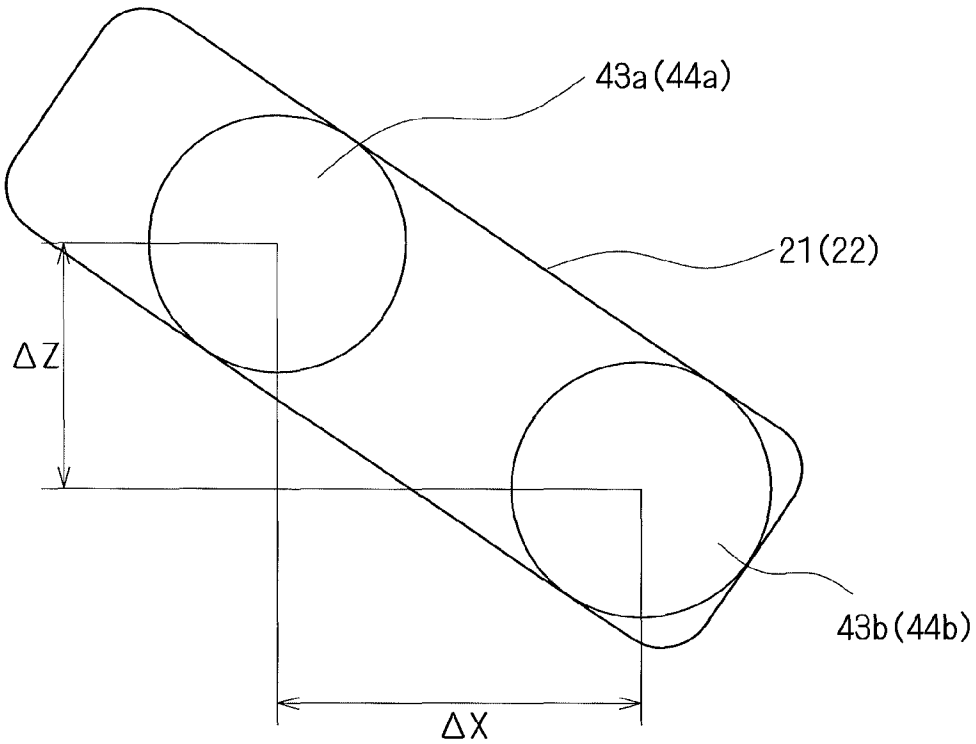
FIGS. 5A and 5B show respective schematic views that illustrate the relative positional relationship between needle eyes and the moving distances and moving directions of a first cam shaft (a second cam shaft) of the threader according to the embodiment of the present invention.
Figure 5A:
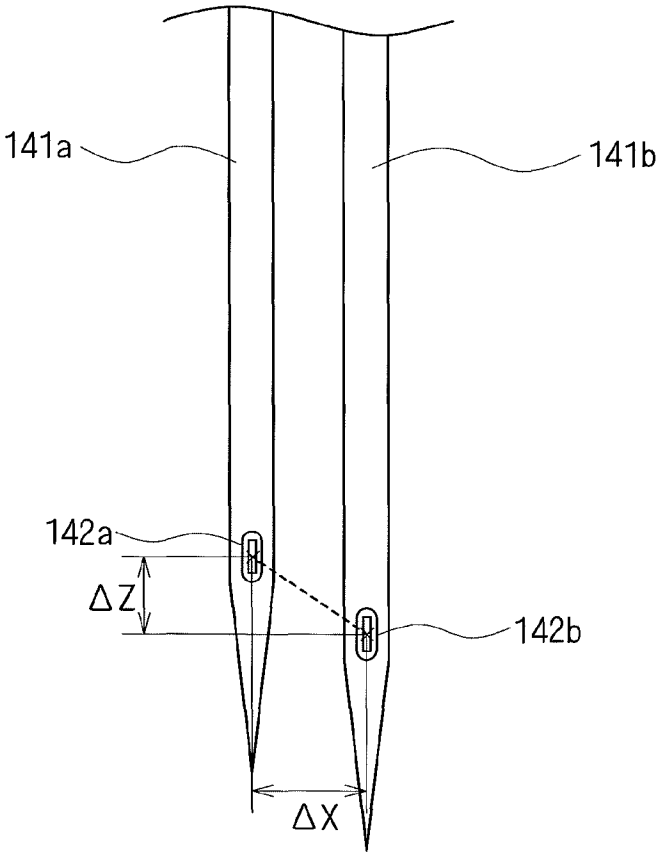

FIG. 5 shows schematic views that illustrate the relative positional relationship between the needle eyes 142*a* and 142*b* and the moving distances and moving directions of the first cam shaft 43 (the second cam shaft 44) of the threader according to the embodiment of the present invention. As shown in FIG. 5A, the sewing needle 141*a* and the sewing needle 141*b* are positioned to be out of alignment by AZ in the height direction and ΔX in the direction orthogonal to the cloth feeding direction. In this case, after the needle eye 142*b* is threaded, the threading shaft 4 is moved upward by ΔZ and in the direction (to the left in FIG. 5) orthogonal to the cloth feeding direction by ΔX, or after the needle eye 142*a* is threaded, the threading shaft 4 is moved downward by ΔZ and in the direction (to the right in FIG. 5) orthogonal to the cloth feeding direction by ΔX, and thereby the needle eyes 142*a* and 142*b* whose positions are different from each other can be threaded alternately.

As shown in FIG. 5B, suppose, for example, the fitting position of the first cam shaft 43 (the second cam shaft 44) has initially been moved to the position 43*b* (44*b*) of the first cam hole 21 (the second cam hole 22) in order to thread the needle eye 142*b*. After the needle eye 142*b* is threaded, the positioning lever 7 is swung to the left and thereby the fitting position of the first cam shaft 43 (the second cam shaft 44) is moved to the upper left along the first cam hole 21 (the second cam hole 22).

Then the fitting position of the first cam shaft 43 (the second cam shaft 44) is moved by the positional difference between the needle eye 142*b* of the sewing needle 141*b* and the needle eye 142*a* of the sewing needle 141*a*, i.e., by AZ in the height direction and ΔX in the direction orthogonal to the cloth feeding direction respectively, to be moved to the position 43*a* (44*a*) of the first cam hole 21 (the second cam hole 22). Thus, the threading shaft 4 that has been moved to the position where the needle eye 142*b* of the sewing needle 141*b* can be threaded can be moved to the position where the needle eye 142*a* of the sewing needle 141*a* can be threaded. Accordingly, a plurality of sewing needles 141*a* and 141*b* can be threaded alternately.

Figure 6:
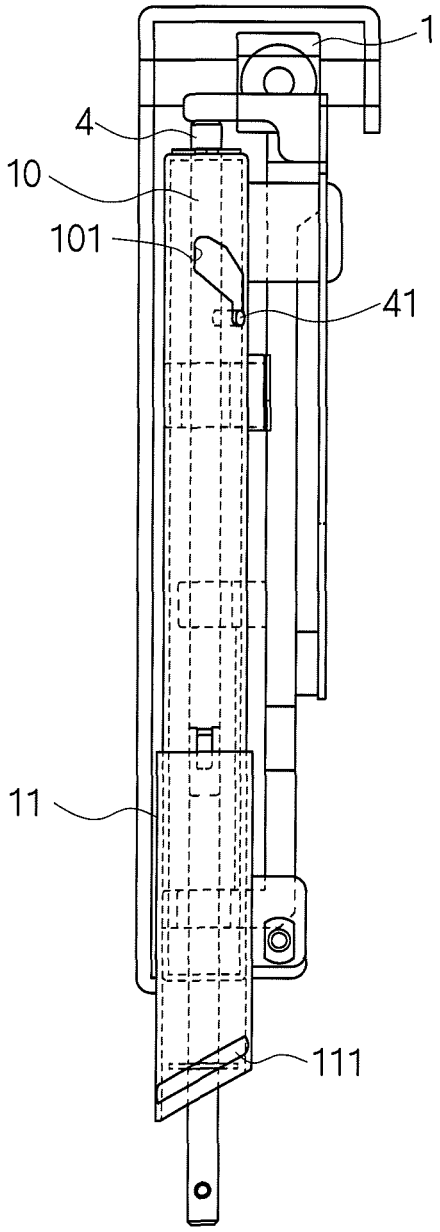
FIG. 6 is a cross sectional view for explaining a cylindrical cam mechanism of the threader for an overlock machine according to the embodiment of the present invention.

FIG. 6 is a cross sectional view for explaining a cylindrical cam mechanism of the threader for an overlock machine according to the embodiment of the present invention. As shown in FIG. 6, the threader according to the present embodiment has a cylindrical cam mechanism (threading guide member) configured with a cylindrical first threading guide 10 and a cylindrical second threading guide 11. The first threading guide 10 and the second threading guide 11 are fitted onto or into the threading shaft 4 and are fixed to the support member 2 (FIG. 1) connected to a needle bar support 1 for supporting the needle bar that vertically moves in proximity. In the present embodiment, in order to allow the cylindrical cam mechanism to function reliably, the threading guide is divided into two, each of which is screwed to the support member 2. It should be understood that there are no particular problems even when the threading guide is not divided but configured as one body.

A third cam shaft 41 that fits in a third cam hole 101 provided for the first threading guide 10 is provided for the threading shaft 4 in such a manner as to protrude from the peripheral surface of the threading shaft 4. When the first threading guide 10 and the second threading guide 11 descend (ascend) in conjunction with descent (ascent) of the sewing needles 141*a*, 141*b*, the fitting position of the third cam shaft 41 moves to the upper left (lower right) along the third cam hole 101 and the threading shaft 4 rotates clockwise (counterclockwise) as viewed from above by the predetermined angle. Accordingly, the threading hook 5 fixed to the lower end of the threading shaft 4 also rotates clockwise (counterclockwise) about the threading shaft 4 as viewed from above by the predetermined angle (a first rotary mechanism).

A fourth cam shaft (not shown in the drawings) that fits in a fourth cam hole 111 provided for the second threading guide 11 is provided for the thread guide member 6 that is attached to the lower end of the threading shaft 4 (the upper part of the threading hook 5) in such a manner as to be rotatable independently from the threading shaft 4. When the first threading guide 10 and the second threading guide 11 descend (ascend) in conjunction with descent (ascent) of the sewing needles 141*a*, 141*b*, the fitting position of the fourth cam shaft moves along the fourth cam hole 111 and the thread guide member 6 rotates in the opposite direction to that in which the threading hook 5 rotates, i.e., counterclockwise (clockwise) about the threading shaft 4 as viewed from above by the predetermined angle (a second rotary mechanism). In this manner, the threading hook 5 and the thread guide member 6 rotate in the opposite directions to each other according to the vertical motion of the one threading shaft 4 and thereby can approach or separate from each other. Accordingly, the operation of threading the needle eyes 142*a*, 142*b* can be controlled by the vertical motion of the threading shaft 4.

FIGS. 7 to 9 show front views, schematic views, and plan views for explaining movements of the threader for an overlock machine according to the embodiment of the present invention. FIGS. 7 to 9 illustrate the case of threading the needle eye 142*b*.

As shown in FIGS. 7 to 9, the threader for an overlock machine according to the embodiment of the present invention is provided with an operating body 17 that can vertically move the threading shaft 4, the first threading guide 10, and the second threading guide 11. The operating body 17 is biased in the direction in which the threading shaft 4 is pulled up. When an operator pushes it down against the biasing force with one hand, the threading shaft 4, the first threading guide 10, and the second threading guide 11 are allowed to descend.

Figure 10:
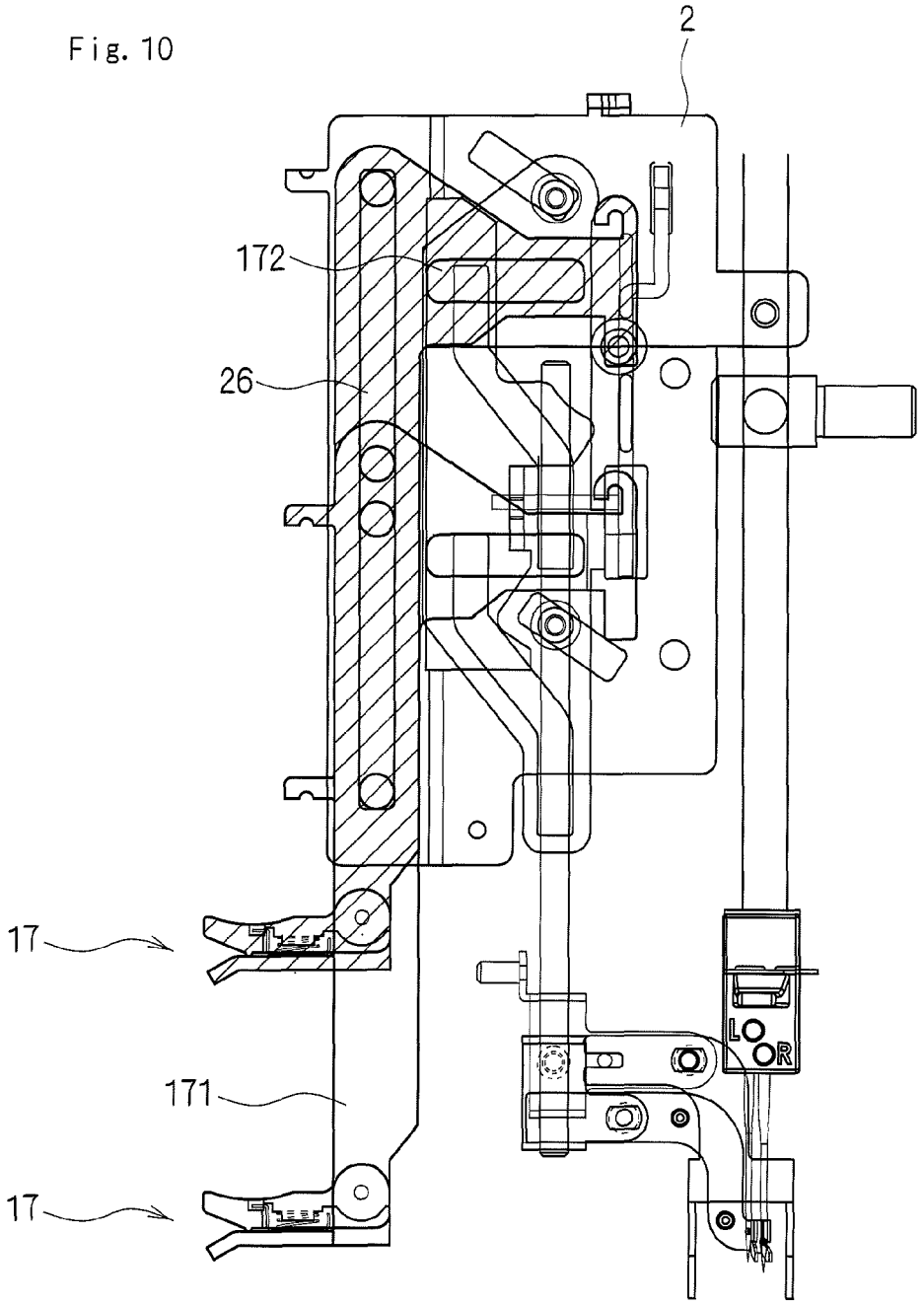
FIG. 10 is a schematic view showing how the operating body 17 is attached, of the threader for an overlock machine according to the embodiment of the present invention.

FIG. 10 is a schematic view showing how the operating body 17 is attached, of the threader for an overlock machine according to the embodiment of the present invention. FIG. 11 shows cross sectional views that illustrate the configuration of the operating body 17 of the threader for an overlock machine according to the embodiment of the present invention. As shown in FIG. 10, a base 171 constituting the operating body 17 vertically moves along a guide hole 26. The base 171 has a hole 172 in which a protruding part, which is not shown in the drawings, of the threading guide 10 fits and is connected to the threading guide 10. As the base 171 moves vertically, the threading guide 10 connected with the base 171 moves vertically.

Figure 11B:
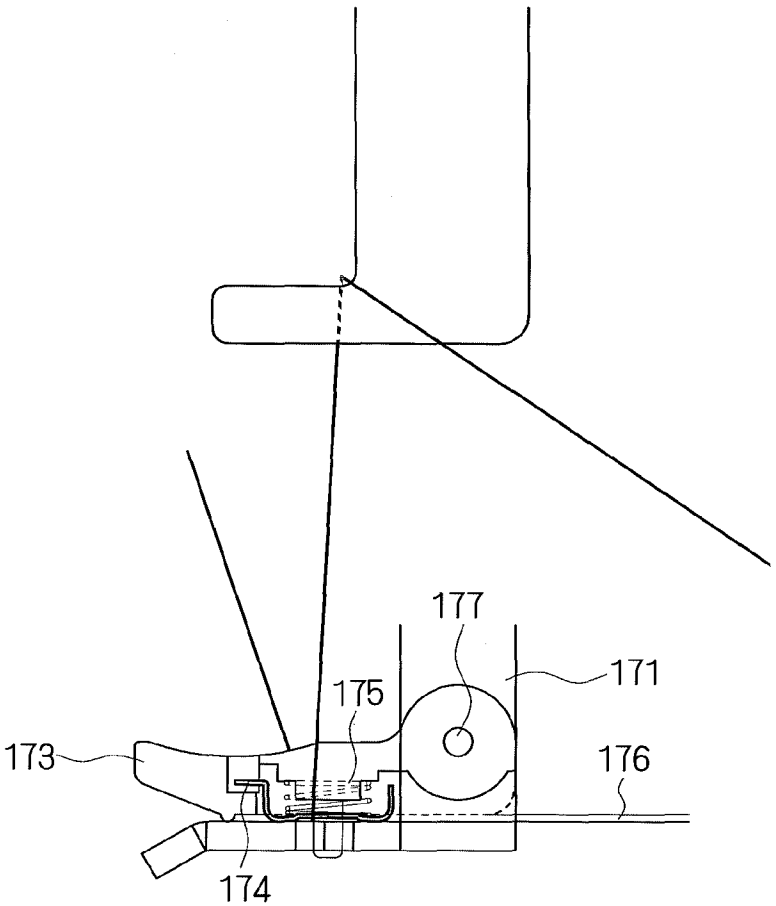
FIGS. 11A & 11B each show cross sectional views that illustrate the configuration of the operating body of the threader for an overlock machine according to the embodiment of the present invention.
Figure 11A:
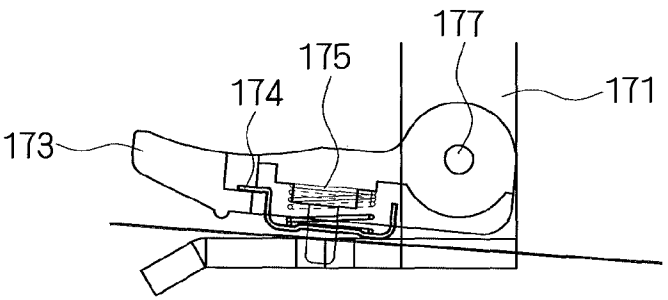

Furthermore, FIG. 11A is a cross sectional view that schematically shows the operating body 17 in the state of not being operated, of the threader for an overlock machine according to the embodiment of the present invention. FIG. 11B is a cross sectional view that schematically shows the operating body 17 in the state of being operated, of the threader for an overlock machine according to the embodiment of the present invention. As shown in FIG. 11A, a needle thread holding part 173 that holds the needle thread between the base 171 and itself is provided rotatably about a rotation axis 177 in such a manner that the lowermost surface thereof can be pushed against the base 171.

The operating body 17 is provided with a compression spring (a second biasing member) 175 that biases the needle thread holding part 173 upward and can guide the needle thread to between the needle thread holding part 173 and the base 171 when the operating body 17 is not operated. The needle thread holding part 173 is provided with a needle thread supporting plate 174 on the lower surface thereof.

As shown in FIG. 11B, the needle thread hooked on the thread guide member 6 is guided to between the needle thread holding part 173 and the base 171 and then the needle thread holding part 173 is pushed down against the biasing force of the compression spring 175. Accordingly, the needle thread is held between the needle thread holding part 173 and the base 171. With the needle thread supporting plate 174 being provided between the needle thread holding part 173 and the base 171, a gap 176 is generated. The needle thread supporting plate 174 is provided in such a manner that the gap 176 is smaller than the diameter of the needle thread, so that it can hold the needle thread without excessive force exerted on the needle thread. Accordingly, the needle thread can be held with a suitable tension, and when an external force such as a pulling force is exerted on the needle thread, for example, when the needle thread is pulled by the hook part 52 of the threading hook 5, the needle thread can be drawn out accordingly. Thus, reliable threading can be carried out.

Figures 7A, 7B, 7C, 7D, 7E, 7F:
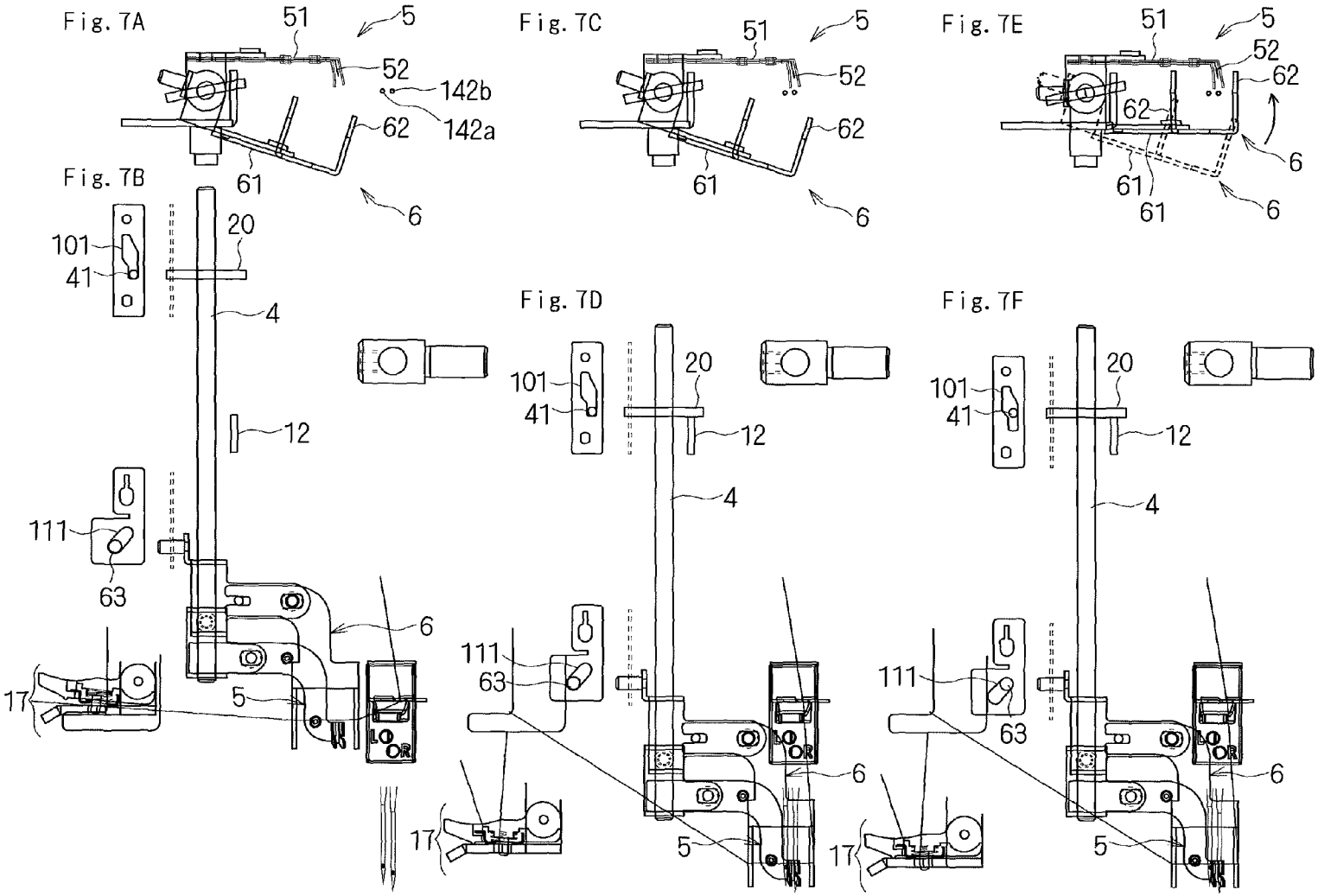
FIGS. 7A-7F show respective front views, schematic views, and plan views for explaining movements of the threader for an overlock machine according to the embodiment of the present invention.

With reference to FIG. 7 again, FIG. 7A is a plan view showing the positional relationship between the threading hook 5 and the thread guide member 6 at the time of the initial state. FIG. 7B shows a schematic view illustrating the state of the cam and a front view at the time of the initial state. FIG. 7C is a plan view showing the positional relationship between the threading hook 5 and the thread guide member 6 at the time when a stopper pin has descended to come into contact with a pin stopper (at the descent limit point of the threading shaft 4). FIG. 7D shows a schematic view illustrating the state of the cam and a front view at the time when the stopper pin has descended to come into contact with the pin stopper (at the descent limit point of the threading shaft 4). FIG. 7E is a plan view showing the positional relationship between the threading hook 5 and the thread guide member 6 at the time when the fitting position of a fourth cam shaft 63 has reached the upper right end of the fourth cam hole 111. FIG. 7F shows a schematic view illustrating the state of the cam and a front view at the time when the fitting position of the fourth cam shaft 63 has reached the upper right end of the fourth cam hole 111.

In FIG. 7A, the threading shaft 4 is located at the uppermost point. When the operator lowers the operating body 17 with one hand, the threading shaft 4, the first threading guide 10, and the second threading guide 11 descend as one. As shown in FIG. 7D, the threading shaft 4 descends to the descent limit point where a stopper pin 20 comes into contact with a pin stopper 12. Since the fitting positions of the third cam shaft 41 and the fourth cam shaft 63 do not move until the threading shaft 4 reaches the descent limit point where the stopper pin 20 comes into contact with the pin stopper 12, as shown in FIGS. 7A and 7C, the threading hook 5 and the thread guide member 6 do not rotate and thus the relative positional relationship does not change.

The threading shaft 4 moves along a guide hole 28 shown in FIG. 1. The guide hole 28 allows the threading shaft 4 to move in parallel while maintaining it in the vertical direction. Therefore, for example, as shown in FIG. 7B, as the threading shaft 4 descends, the threading shaft 4 moves in the direction approaching the needle eyes 142*a*, 142*b* of the sewing needles 141*a*, 141*b*.

When the operator further lowers the operating body 17 with one hand and the position shown in FIG. 7F, i.e., the fitting position of the third cam shaft 41, has moved vertically to the upper part of the third cam hole 101, the threading shaft 4 does not rotate and only the first threading guide 10 and the second threading guide 11 shown in FIG. 6 further descend. Accordingly, the threading hook 5 does not rotate. On the other hand, the fitting position of the fourth cam shaft 63 starts moving towards the upper right along the fourth cam hole 111. As shown in FIG. 7E, the thread guide member 6 rotates counterclockwise about the threading shaft 4 as viewed from above and thereby moves in the direction approaching the needle bar 15. When the fitting position of the fourth cam shaft 63 has reached the upper right end of the fourth cam hole 111, as shown in FIG. 7E, the thread guide member 6 rotates to the position where the thread hooking part 62 located at the tip of the thread guide member 6 passes the sewing needles 141*a*, 141*b* as viewed from above.

Figures 8A, 8B, 8C, 8D, 8E, 8F:
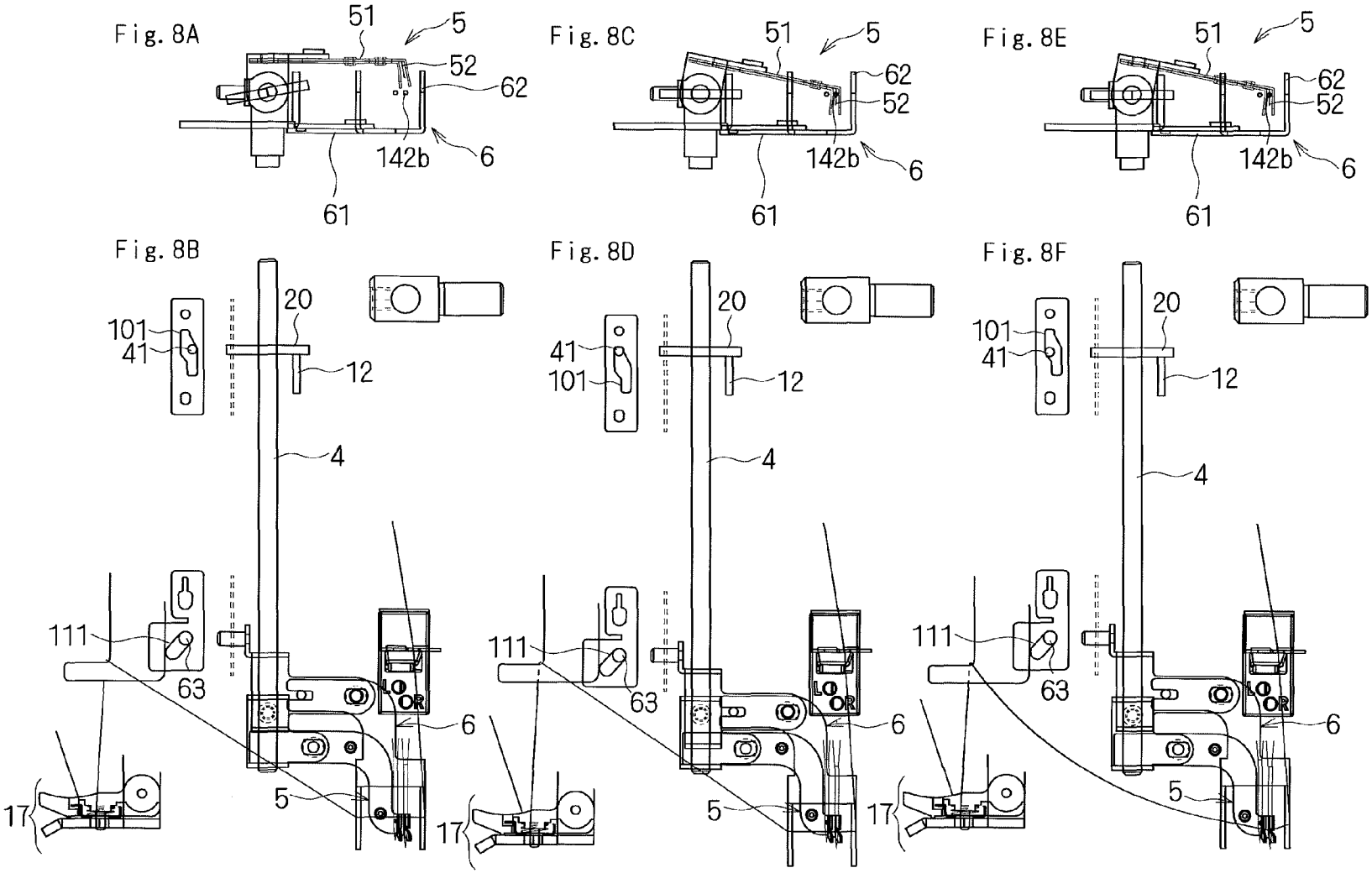
FIGS. 8A-8F show respective front views, schematic views, and plan views for explaining movements of the threader for an overlock machine according to the embodiment of the present invention.

FIG. 8A is a plan view showing the positional relationship between the threading hook 5 and the thread guide member 6 at the time when the threading hook 5 starts rotating. FIG. 8B shows a schematic view illustrating the state of the cam and a front view at the time when the threading hook 5 starts rotating. FIG. 8C is a plan view showing the positional relationship between the threading hook 5 and the thread guide member 6 at the time when the operating body 17 has reached the lowest point. FIG. 8D shows a schematic view illustrating the state of the cam and a front view at the time when the operating body 17 has reached the lowest point. FIG. 8E is a plan view showing the positional relationship between the threading hook 5 and the thread guide member 6 at the time when the fitting position of the third cam shaft 41 has descended along the third cam hole 101. FIG. 8F shows a schematic view illustrating the state of the cam and a front view at the time when the fitting position of the third cam shaft 41 has descended along the third cam hole 101.

When the operator further lowers the operating body 17 with one hand, the first threading guide 10 and the second threading guide 11 shown in FIG. 6 further descends. The fitting position of the third cam shaft 41 starts moving towards the upper left along the third cam hole 101. With the fitting position of the third cam shaft 41 moving towards the upper left along the third cam hole 101, as shown in FIG. 8C, the threading hook 5 rotates clockwise about the threading shaft 4 as viewed from above and thereby the hook part 52 of the threading hook 5 is inserted into the needle eye 142*b*. On the other hand, the fitting position of the fourth cam shaft 63 remains in the state where it has reached the upper right end of the fourth cam hole 111 even when the operating body 17 is further lowered as shown in FIG. 8D. Accordingly, as shown in FIG. 8C, the thread guide member 6 does not rotate. In this case, since the fitting position of the third cam shaft 41 moves towards the upper left along the third cam hole 101, the threading shaft 4 rotates clockwise as viewed from above and the stopper pin 20 also rotates clockwise as the threading shaft 4 rotates. Thus, the pin stopper 12 can be of any size that allows the pin stopper 12 to be in contact with the stopper pin 20 even when the stopper pin 20 has rotated.

In the present embodiment, the lengths and inclined angles of the third cam hole 101 and the fourth cam hole 111 are configured so that the fitting position of the fourth cam shaft 63 reaches the upper right end of the fourth cam hole 111 before the fitting position of the third cam shaft 41 reaches the upper left end of the third cam hole 101. This makes it possible that only the thread guide member 6 rotates until the fitting position of the fourth cam shaft 63 reaches the upper right end of the fourth cam hole 111, while after the fitting position of the fourth cam shaft 63 has reached the upper right end of the fourth cam hole 111, the thread guide member 6 does not rotate and only the threading hook 5 can be rotated. Also, it is preferable that a first biasing member, for example, a compression spring (not shown in the drawings), is provided, that biases the thread guide member 6 in such a manner that the thread guide member 6 approaches the threading hook 5. This is because in this case, the thread hooking part 62 of the thread guide member 6 can approach the hook part 52 of the threading hook 5 from below and thereby the needle thread hooked on the thread hooking part 62 can be guided reliably to the hook part 52 by the elastic force of the compression spring. It should be understood that with no first biasing member, the operator can pull up the operating body 17 manually. With the lengths and inclined angles of the cam holes being configured in this manner, the operation timing between the rotation of the threading hook 5 and the rotation of the thread guide member 6 can be adjusted and thereby threading can be carried out more reliably.

In the present embodiment, before the hook part 52 of the threading hook 5 is inserted into the needle eye 142*b*, the thread guide member 6 finishes rotating, and at the time when the operating body 17 has reached the lowest point, the thread guide member 6 is in the state where it has been pushed down further than the hook part 52 of the threading hook 5. In this state, for example, when the operator releases his/her hand from the operating body 17, the thread guide member 6 is pushed up by the elastic force of the compression spring. With the thread guide member 6 being pushed up, the needle thread hooked on the thread hooking part 62 of the thread guide member 6 can be guided reliably to the hook part 52 of the threading hook 5. Thus, as shown in FIGS. 8E and 8F, with no change in the horizontal positional relationship between the threading hook 5 and the thread guide member 6, only the thread guide member 6 is pushed up by the elastic force of the compression spring, and the needle thread hooked on the thread hooking part 62 of the thread guide member 6 to be guided to the hook part 52 of the threading hook 5 can be hooked reliably on the hook part 52.

Figures 9A, 9B, 9C, 9D:
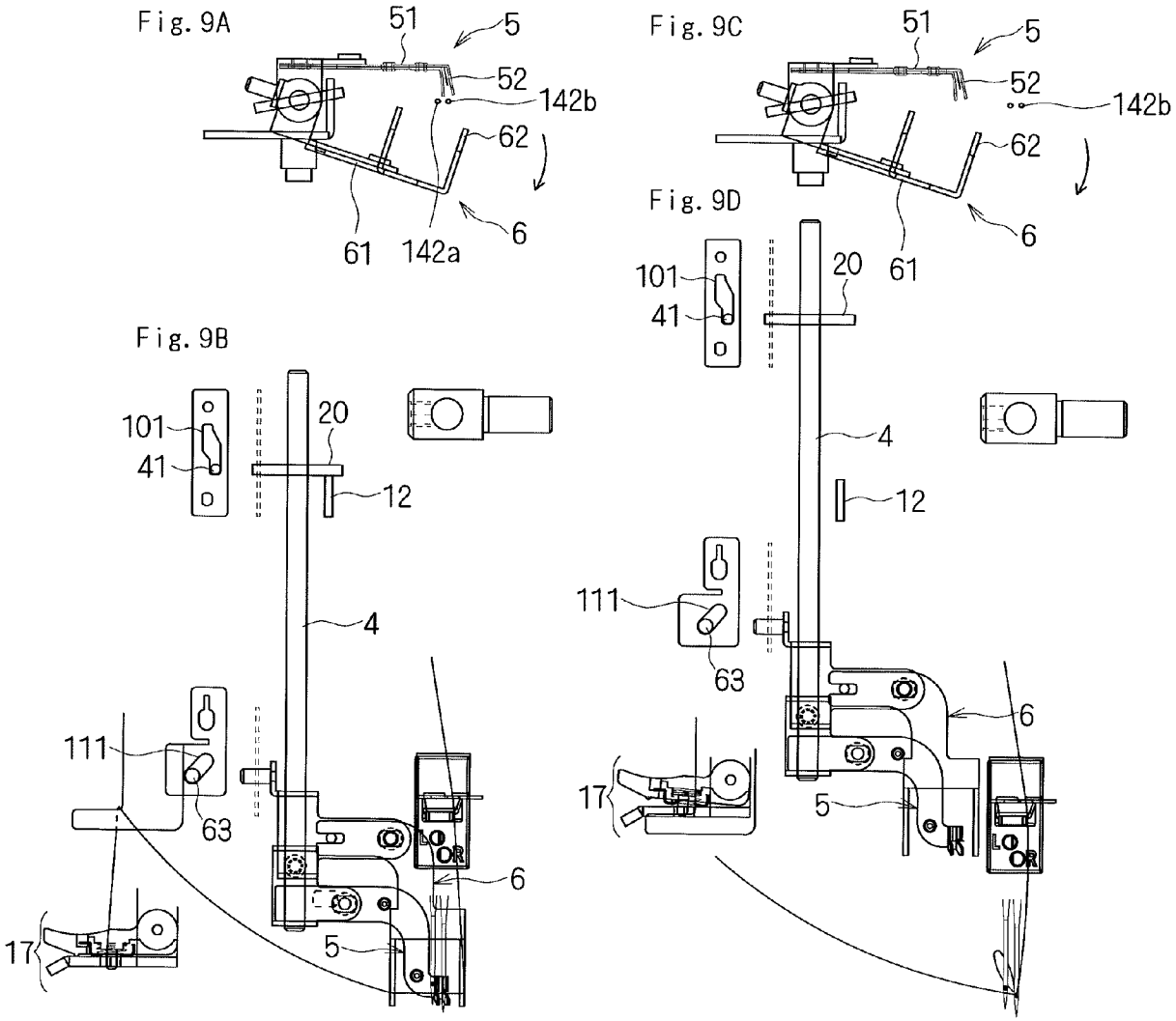
FIG. 9 shows front views, schematic views, and plan views for explaining movements of the threader for an overlock machine according to the embodiment of the present invention.

FIG. 9A is a plan view showing the positional relationship between the threading hook 5 and the thread guide member 6 at the time when the hook part 52 of the threading hook 5 has come out of the needle eye 142*b*. FIG. 9B shows a schematic view illustrating the state of the cam and a front view at the time when the hook part 52 of the threading hook 5 has come out of the needle eye 142*b*. FIG. 9C shows a schematic view illustrating the state of the cam and a front view at the time when the stopper pin 20 has ascended to separate from the pin stopper 12. FIG. 9D is a plan view showing the positional relationship between the threading hook 5 and the thread guide member 6 at the time when the stopper pin 20 has ascended to separate from the pin stopper 12.

When the operator lifts the operating body 17 with one hand, as shown in FIG. 9B, the fitting position of the third cam shaft 41 moves to the lower right end along the third cam hole 101. Accordingly, as shown in FIG. 9A, the threading hook 5 rotates counterclockwise about the threading shaft 4 as viewed from above and thereby the hook part 52 of the threading hook 5, on which the needle thread is hooked, comes out of the needle eye 142*b*. This allows the needle thread to pass through the needle eye 142*b* and thereby threading is carried out. On the other hand, the fitting position of the fourth cam shaft 63 also moves to the lower left end along the fourth cam hole 111 and thereby, as shown in FIG. 9A, the thread guide member 6 rotates clockwise about the threading shaft 4 as viewed from above.

When the operator further lifts the operating body 17 with one hand, the stopper pin 20 separates from the pin stopper 12 and then the threading shaft 4, the first threading guide 10, and the second threading guide 11 ascend as one. Since the fitting positions of the third cam shaft 41 and the fourth cam shaft 63 do not move, the threading hook 5 and the thread guide member 6 do not rotate. The threading shaft 4 moves along the guide hole 28 shown in FIG. 1. The guide hole 28 allows the threading shaft 4 to move in parallel while maintaining it in the vertical direction. Therefore, for example, as the threading shaft 4 ascends, as shown in FIG. 9D, the threading shaft 4 moves in the direction away from the needle eyes 142*a*, 142*b* of the sewing needles 141*a*, 141*b*. Thus, threading the needle eye 142*b* is completed.

As described above, according to the present embodiment, with the needle thread being hooked on the thread hooking part 62 of the thread guide member 6, after the hook part 52 of the threading hook 5 is inserted into any one of the needle eyes, the needle thread guided by the thread guide member 6 is hooked onto the hook part 52. With the hook part 52 coming out of any one of the needle eyes, the needle thread passes through the needle eye and thereby threading is carried out. Thus, threading can be carried out reliably according to the vertical motion of one threading shaft 4 and therefore the whole machine can be made compact and the cost thereof can be reduced. Furthermore, the threading shaft 4 moves according to the relative positional relationship between the needle eyes of the plurality of sewing needles. Therefore, even when the heights of the needle eyes are different from each other according to the sewing needles, threading can be carried out reliably.

In addition to the above, the present invention can be carried out, with the above-described embodiment being altered variously without departing from the spirit of the present invention.

DESCRIPTIONS OF NUMBERS

2 Support Member
4 Threading Shaft
5 Threading Hook
6 Thread Guide Member
7 Positioning Lever (Operating Member)
10 First Threading Guide (Threading Guide Member)
11 Second Threading Guide (Threading Guide Member)
12 Pin Stopper
15 Needle Bar
17 Operating Body
20 Stopper Pin
21 First Cam Hole
22 Second Cam Hole
41 Third Cam Shaft
43 First Cam Shaft
44 Second Cam Shaft
51 First Guide Part

52 Hook Part
61 Second Guide Part
62 Thread Hooking Part
63 Fourth Cam Shaft
101 Third Cam Hole
111 Fourth Cam Hole
141*a*, 141*b* Sewing Needle
142*a*, 142*b* Needle Eye
171 Base
173 Needle Thread Holding Part
175 Compression Spring (Second Biasing Member)

The invention claimed is:

1. A threader for an overlock machine, comprising:

a threading shaft that is located near a needle bar, which collectively and vertically moves a plurality of sewing needles attached thereto, that can move in substantially parallel with a direction of vertical motion of the needle bar, and that is supported rotatably, with the direction of vertical motion of the needle bar being taken as a rotation axis;

a threading hook that is fixed to a lower end of the threading shaft and that includes a hook part, which can be inserted into a needle eye of a sewing needle and a first guide part for guiding the hook part to the needle eye;

a first rotary mechanism that rotates the threading hook by a predetermined angle so that the hook part is inserted into the needle eye of the sewing needle in a vicinity of a descent limit point of the threading shaft;

a thread guide member that has a thread hooking part for hooking a needle thread and a second guide part for guiding the needle thread hooked on the thread hooking part towards the needle eye of the sewing needle and that guides the needle thread to the hook part in the vicinity of the descent limit point of the threading shaft; and a second rotary mechanism that rotates the thread guide member by the predetermined angle so that the thread hooking part intersects the sewing needle beyond the position of the sewing needle in the vicinity of the descent limit point of the threading shaft, wherein the first rotary mechanism and the second rotary mechanism rotate the threading hook and the thread guide member in opposite directions to each other, and the threading shaft moves according to a relative positional relationship between the needle eyes of the plurality of sewing needles.

2. The threader for an overlock machine according to claim 1, wherein a support member that supports the threading shaft and that is fixed to an overlock machine body has a hole cam mechanism configured with a first cam hole, in which a first cam shaft provided in an upper part of the threading shaft fits, and a second cam hole, in which a second cam shaft provided in a lower part of the threading shaft fits, and the threading shaft is moved according to an operation of an operating member that moves a fitting position of the first cam shaft and a fitting position of the second cam shaft.

3. The threader for an overlock machine according to claim 1, comprising a threading guide member that is fitted onto or into the threading shaft to be fixed to the support member and that has a third cam hole and a fourth cam hole, wherein the first rotary mechanism is configured with the third cam hole and a third cam shaft that is provided for the threading shaft and that fits in the third cam hole, the second rotary mechanism is configured with the fourth cam hole and a fourth cam shaft that is provided for the thread guide member and that fits in the fourth cam hole, an inclined direction of the third cam hole is opposite to an inclined direction of the fourth cam hole, and a first biasing member is provided between the threading hook and the thread guide member, that biases the thread guide member in such a manner that the thread guide member approaches the threading hook.

4. The threader for an overlock machine according to any one of claim 1, comprising an operating body that vertically moves the threading shaft.

5. The threader for an overlock machine according to claim 4, wherein the operating body comprises:

a base that is connected to the threading guide member and vertically moves the threading guide member;

a needle thread holding part that holds the needle thread between the base and itself; and a second biasing member that biases the needle thread holding part upwards, and when the needle thread holding part is pushed down, a gap smaller than a diameter of the needle thread is generated between the base and the needle thread holding part.

* * * * *